US005975731A

United States Patent [19]

Saladin et al.

[11] Patent Number: 5,975,731

[45] Date of Patent: Nov. 2, 1999

[54] VEHICLE HEADLIGHT WITH REFLECTIVE MASK

[75] Inventors: Denis Saladin, Sceaux; Eric Blusseau, Rueil-Malmaison, both of France

[73] Assignee: Valeo Vision, Cedex, France

[21] Appl. No.: 08/890,102

[22] Filed: Jul. 9, 1997

[30] Foreign Application Priority Data

Jul. 11, 1996 [FR] France ..... 96 08670

[51] Int. Cl.[6] ..... F21M 3/14; F21V 7/00

[52] U.S. Cl. ..... 362/518; 362/507; 362/303

[58] Field of Search ..... 362/518, 507, 362/351, 509, 303, 487

[56] References Cited

U.S. PATENT DOCUMENTS 4,495,552 1/1985 Graff .

FOREIGN PATENT DOCUMENTS 0 371 510 11/1989 European Pat. Off. .
0 466 605 1/1992 European Pat. Off. .
23 51 633 4/1975 Germany .
2 054 815 2/1981 United Kingdom .

OTHER PUBLICATIONS

French Search Report dated Apr. 4, 1997.

*Primary Examiner*—Sandra O'Shea
*Assistant Examiner*—Marshall Honeyman
*Attorney, Agent, or Firm*—Morgan & Finnegan LLP

[57] ABSTRACT

A motor vehicle headlight comprises a reflector, a bulb, a glass, and a direct light mask provided in front of the bulb and mounted on the reflector by at least one generally vertical bracket. The reflector has a reflective surface capable of generating by itself a beam whose light is distributed widthwise in a homogeneous manner, between a zero inclination and a maximum inclination. The reflector has two lateral zones delimited by axial vertical limit-planes passing in the vicinity of the edges of the bracket or brackets, the reflective surfaces of which are such that the radiation changes progressively, from these limit-planes, between an essentially zero horizontal deviation and a divergent horizontal deviation, and a central zone situated between the said limit-planes and capable of directing a substantial part of the radiation away from the transition zones constituted by the edges of the bracket or brackets.

14 Claims, 3 Drawing Sheets

PRIOR ART

PRIOR ART

VEHICLE HEADLIGHT WITH REFLECTIVE MASK

FIELD OF THE INVENTION

The present invention relates generally to motor vehicle headlights, and more precisely a headlight having a mask situated in front of the bulb and intended to avoid direct light emitted by the bulb being liable to dazzle the drivers of vehicles travelling in the opposite direction, and to avoid discomfort for the driver caused by light rising in rainy or foggy conditions.

BACKGROUND OF THE INVENTION

Such a mask may be incorporated into the bulb, or an added component fixed on the bulb-holder or on the reflector. In certain headlights, the mask is mounted on one or two vertical brackets extending between the top and/or bottom of the reflector and the region situated in front of the bulb, where they hold the mask.

It has been found that the presence of these brackets undesirably modifies the photometry of a light beam obtained using a reflector which is capable of generating by itself, that is to say without action of the sealing glass, a beam with a wide cut-off.

Examples of such automatic width-generating reflectors are described for example in the documents FR-A-2 609 148, FR-A-2 639 888 and FR-A-2 664 677 in the name of the applicant.

A known headlight has a bulb, and with a bulb filament and a direct light mask provided in front of the bulb also has two vertical brackets connecting the direct light mask to the upper and lower regions of a reflector in which the bulb is mounted. A width-generating reflector surface forms a European type dipping beam unit.

In this lamp, the bracket obstructs the passage of reflected rays directed towards it, and it turns out that, with the type of reflector considered, the occulted rays would cover an angular range for example from −2° to +2° in the beam formed. As a result of the occultation, a lack of light occurs in a fault zone which is slightly offset to the right, simply as a result of the reflective surfaces being, in a manner known per se, designed to offset at least part of the light slightly to the right with respect to the center of a reference projection screen.

OBJECT OF THE INVENTION

The present invention aims to at least partially overcome this drawback and propose a headlight which, despite the presence of at least one vertical mask-holding arm, and maintaining the principle of surfaces which automatically generate cut-off and beam width, generates a beam at least substantially without the aforementioned fault.

SUMMARY OF THE INVENTION

According to the present invention there is proposed a headlight for a motor vehicle comprising a reflector, a bulb mounted in the reflector and a glass, a direct light mask being provided in front of the bulb and mounted on the reflector by means of at least one generally vertical bracket connected to the reflector in the upper and/or lower region of the latter, and the reflector having a reflective surface capable of generating by itself, without any action of the glass, a beam whose light is distributed widthwise in a homogeneous manner, between a zero inclination and a maximum inclination, wherein the reflector has two lateral zones delimited by axial vertical limit-planes passing substantially in the region of the left and right edges of the bracket or brackets, the reflective surfaces of which are such that the radiation changes progressively, from these limit-planes, between an essentially zero horizontal deviation and a divergent horizontal deviation, and a central zone situated between the said limit-planes and capable of directing a substantial part of the radiation it reflects away from the transition zones constituted by the edges of the bracket or brackets.

Preferred, but non-limiting, aspects of embodiments of the invention are as follows:

the central zone has a horizontal profile of parabolic type, so as to direct the reflected radiation towards the bracket or brackets.

the central zone has a horizontal basic profile extending, with continuity, the horizontal profiles of the lateral zones, and essentially vertical ridges applied on this basic profile, so as to disperse the reflected radiation widthwise.

two brackets are provided extending respectively above and below the direct light mask, and the central zone extends over the whole height of the reflector.

BRIEF DESCRIPTION OF THE DRAWINGS

Other aspects, aims and advantages of the present invention will emerge better from a reading of the following detailed description of embodiments of the invention, given by way of example and made with reference to the accompanying drawings, in which.

DESCRIPTION OF THE PREFERRED EMBODIMENTS

In the figures like numerals refer to like parts.

Figure 1:
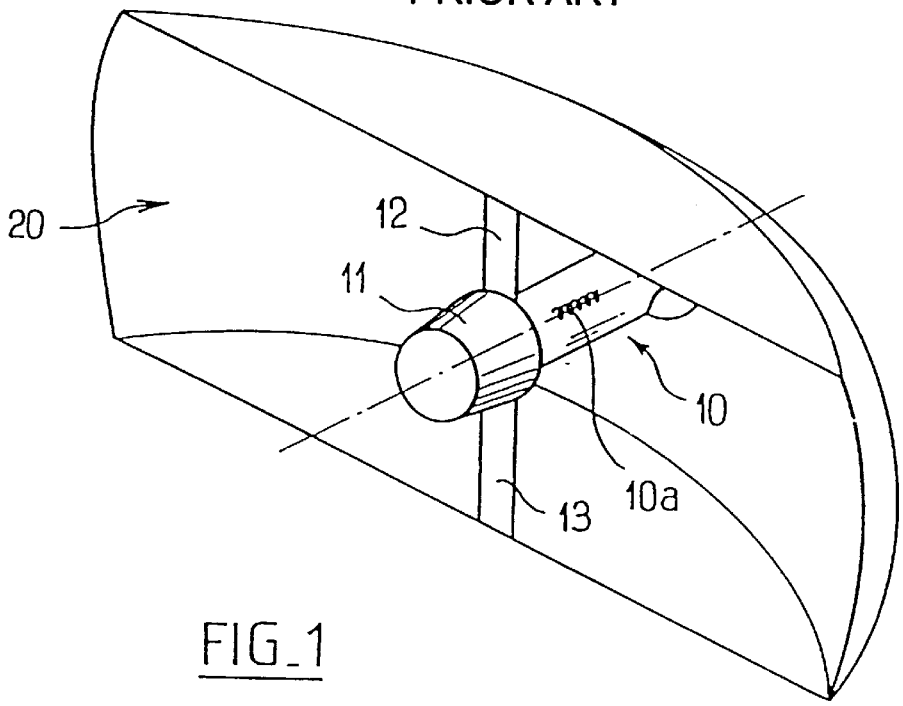
FIG 1 PRIOR ART
FIG. 1 is a perspective view of part of a known headlight.

FIG. 1 shows a headlight having a bulb 10 with filament 10*a*, a direct light mask 11 provided in front of the bulb, and two vertical brackets 12, 13 connecting the direct light mask to the upper and lower regions of a reflector 20 in which the bulb is mounted, and having a width-generating reflector surface intended to form a European type dipping beam unit.

Figure 2:
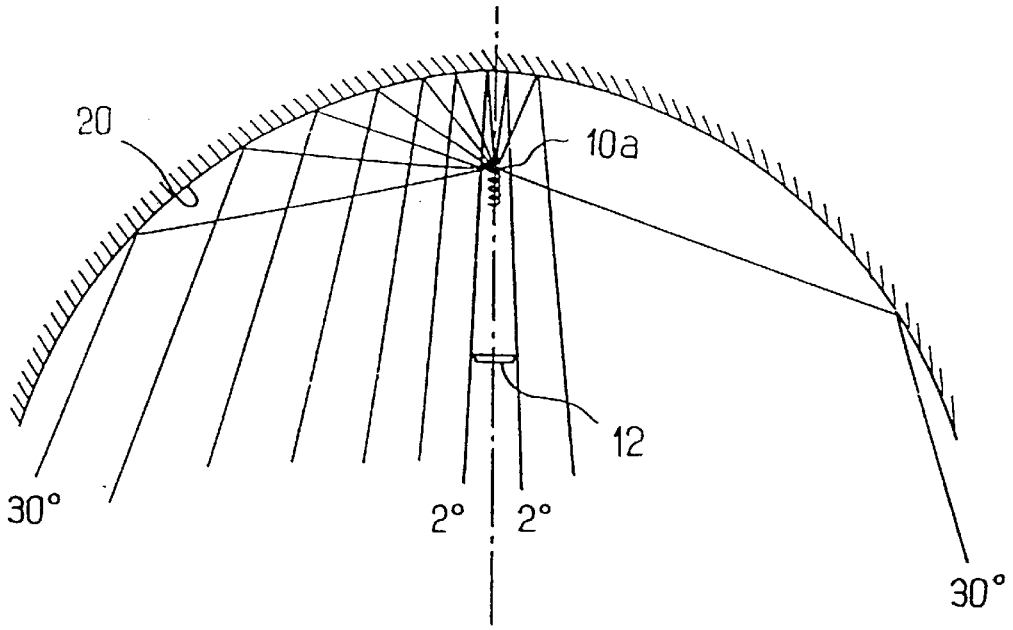
FIG. 2 is a cross-sectional view through the headlight of FIG. 1, showing rays of light being reflected by the reflector.

FIG. 2 shows that the bracket 12 obstructs the passage of reflected rays directed towards it. With the type of reflector considered, the occulted rays cover an angular range for example from −2° to +2° in the beam formed.

Figure 3:
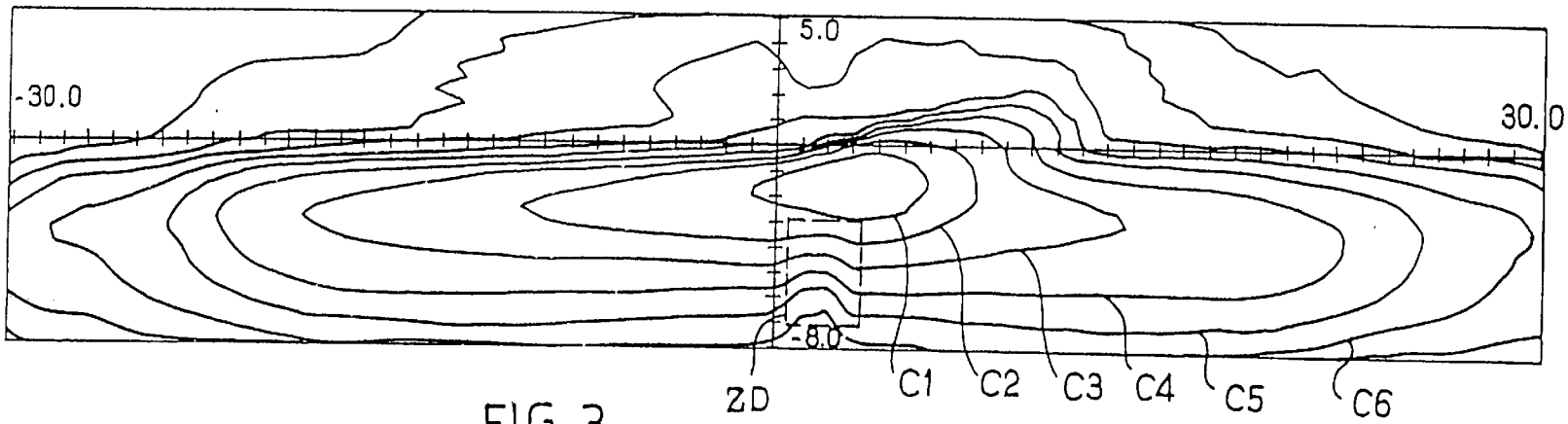
FIG. 3 shows a set of isocandela curves Ci for the headlight of FIG. 1.

FIG. 3 illustrates, by means of a set of isocandela curves Ci, the appearance of the beam obtained, in the absence of the sealing glass, with these occulted rays. In the case in point this is a European type dipping beam unit with right-hand turning of the cut-off (for driving on the right). As a result of the occultation, a lack of light in a fault zone ZD can be clearly seen. It can also be seen that this fault zone is slightly offset to the right, simply as a result of the reflective surfaces being, in a manner known per se, designed to offset at least part of the light slightly to the right with respect to the center of a reference projection screen.

Figure 4:
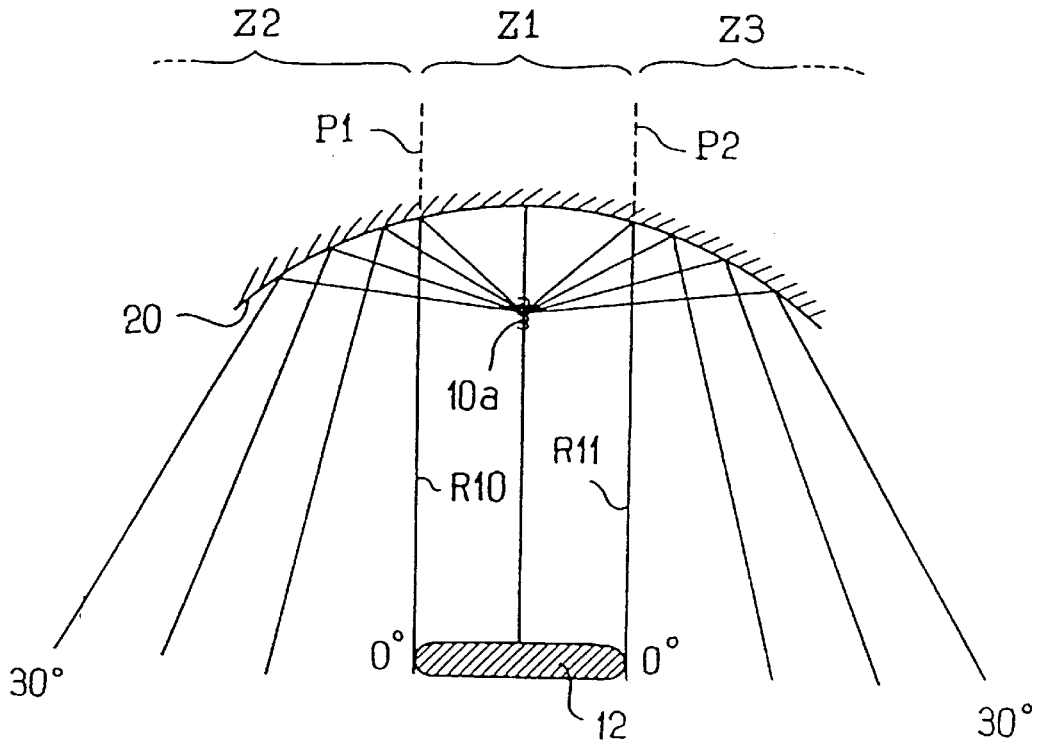
FIG. 4 is a schematic partial horizontal cutaway view of part of a headlight according to a first embodiment of the invention.

In order to avoid the presence of the brackets 12, 13 creating a localized lack of light in the emitted beam, a reflector having three zones is provided in the embodiment of FIG. 4. A central zone Z1 extends vertically at right angles to the brackets, that is to say between two planes P1 and P2 passing in close proximity to the lateral edges of the brackets, and has a parabolic horizontal section focused on the filament 10*a* of the bulb 10. In this way, the greatest part of the radiation reflected by the zone Z1 strikes the internal face of the brackets 12, 13 and is occulted by them.

This central zone Z1 is bordered by two lateral zones Z2 and Z3 which are surfaces designed in accordance with one or other of the documents referred to in the introduction, but modified so as to provide, in the region of the limit-planes P1 and P2, a substantially zero horizontal deviation of the light, as shown by the ray lines R10 and R11. As the distance from these planes increases, the horizontal deviation becomes greater, to give to the beam, without any significant action of the sealing glass being necessary.

Those skilled in the art will be able to produce the reflective surfaces of the zones Z2 and Z3 as defined above, notably from instructions in FR-A-2 664 677, this document describing clearly the manner of producing surfaces which automatically generate wide cut-off beams with very flexible parameterizing of the angles of reflection in the horizontal direction.

Figure 6:
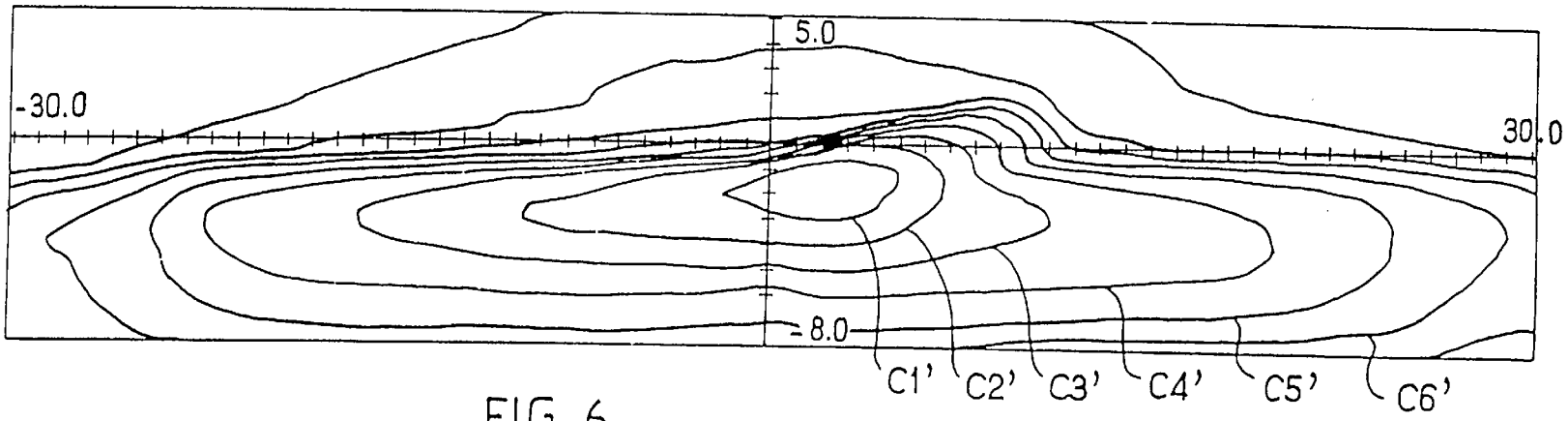
FIG. 6 illustrates by means of a set of isocandela curves the appearance of the beam obtained with the headlight according to FIG. 5.

It can be seen in FIG. 6 that the beam obtained, depicted in the form of isocandela curves Ci' and which is a European type dipping beam unit with right-hand turning of the cut-off (for driving on the right), has an entirely satisfactory homogeneity insofar as the zones Z2 and Z3 of the reflector cover all the required angular range between 0° and, in the present example, around 30°.

Figure 5:
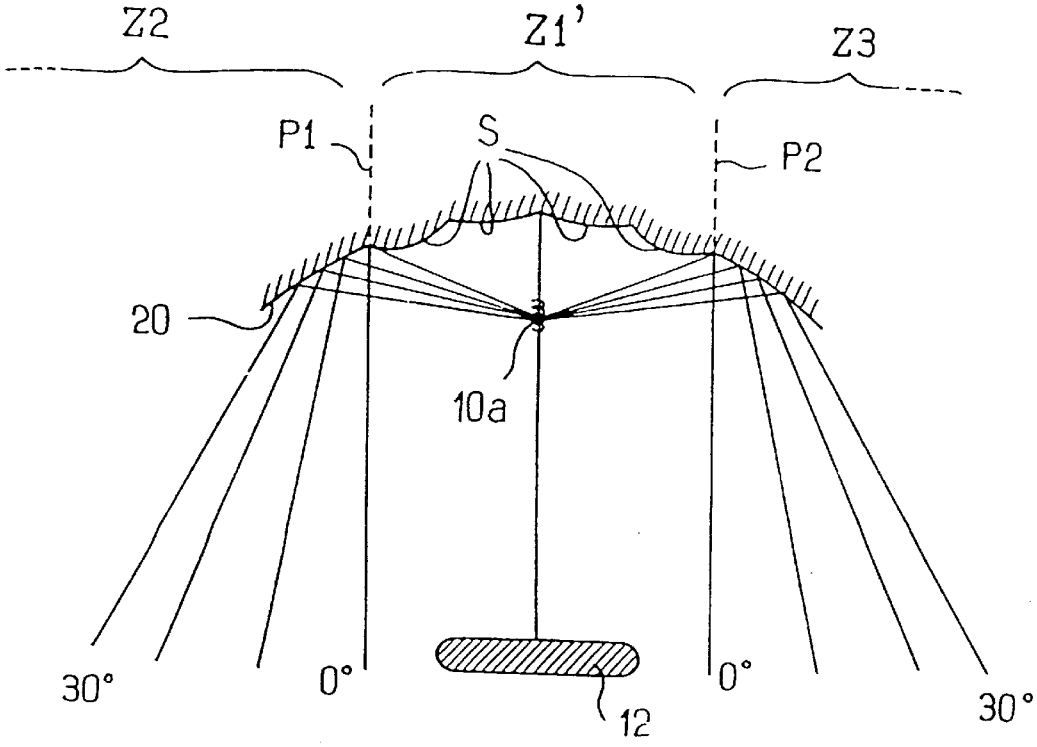
FIG. 5 is a schematic partial horizontal cutaway view of part of a headlight according to a second embodiment of the invention.

FIG. 5 of the drawings shows another embodiment of the invention. The lateral zones Z2 and Z3 of the reflector 20 are here identical to those of the embodiment of FIG. 4, while the central zone Z1' is a zone which has a basic profile in accordance with the instructions in the aforementioned documents, and extending the surfaces of the zones Z2 and Z3 without a break, on which vertical ridges S are projected, in the case in point four in number and of substantially constant width, intended to provide a significant widthwise diffusion of the light on reflection of the rays originating from the filament 10*a*. In this way, the reflected light contributes towards strengthening the luminous intensity of the beam widthwise, and no lack of homogeneity of the beam is perceptible since the transition region situated in the region of the left and right edges of the brackets 12, 13 is exposed from the zone Z1 only to a radiation of very reduced intensity.

It should be understood that the beam obtained will in this case be similar to that of FIG. 6.

It should also be noted that, insofar as the zone Z1' in this case causes no significant loss of flux, its width may if necessary, and as illustrated in FIG. 5, be slightly greater than that of the brackets 12 and 13.

The invention is not limited to the described embodiments. Alternative arrangements and equivalent structures within the spirit and scope of the invention will readily occur to the skilled person.

What we claim is:

1. A headlight for a vehicle comprising:

a reflector;

a bulb mounted in the reflector, the bulb having a filament; and a direct light mask disposed blockingly in relation to the bulb and mounted on the reflector by at least one mounting bracket which is generally vertically disposed and connected to the reflector;

the reflector comprising:

lateral zones delimited by axial vertical limit-planes, the lateral zones having continuously curved reflective surfaces such that the radiation changes progressively, from these limit-planes, between an essentially zero horizontal deviation and a divergent horizontal deviation without any action of a glass, and a central zone situated between the vertical limit-planes having a parabolic horizontal profile focused on the filament of the bulb thereby directing a substantial part of the radiation reflected by the central zone toward the bracket or brackets.

2. A headlight for a vehicle comprising:

a reflector;

a bulb mounted in the reflector; and a direct light mask disposed blockingly in relation to the bulb and mounted on the reflector by at least one mounting bracket which is generally vertically disposed and connected to the reflector, the mounting bracket or brackets each having a left edge and a right edge;

the reflector comprising:

lateral zones delimited by axial vertical limit-planes, the lateral zones having reflective surfaces such that the radiation changes progressively, from these limit-planes, between an essentially zero horizontal deviation and a divergent horizontal deviation without any action of a glass; and a central zone situated between the vertical limit-planes, the central zone comprising:

a horizontal basic profile extending continuously between the parabolic horizontal profiles of the lateral zones; and essentially vertical ridges superimposed upon the horizontal basic profile.

3. A headlight according to claim 2, wherein the vertical ridges comprise a plurality of concavities superimposed on the horizontal basic profile.

4. A headlight according to claim 3, wherein the concavities are each of substantially constant width.

5. A headlight according to claim 4, having four concavities.

6. A headlight according to claim 2, comprising two brackets extending, respectively, above and below the direct light mask.

7. A headlight according to claim 2, further comprising two lateral zones delimited by axial vertical limit-planes passing in the vicinity of the left and right edges of the bracket or brackets.

8. A headlight according to claim 2, wherein the central zone extends over the entire height of the reflector.

9. A headlight according to claim 1, comprising two brackets extending, respectively, above and below the direct light mask.

10. A headlight according to claim 1, comprising two lateral zones delimited by axial vertical limit-planes passing in the vicinity of the left and right edges of the bracket or brackets.

11. A headlight according to claim 1, wherein the parabolic horizontal profile is continuously convex.

12. A headlight according to claim 1, wherein the central zone extends over the entire height of the reflector.

13. A headlight for a vehicle comprising:

a reflector;

a bulb mounted in the reflector; and a direct light mask disposed blockingly in relation to the bulb and mounted on the reflector by at least one mounting bracket which is generally vertically disposed and connected to the reflector;

the reflector comprising:

at least one continuously curved surface having means for generating, without any action of a glass, a beam of light distributed widthwise in a substantially homogeneous manner between a zero inclination and a maximum inclination, and a central zone comprising means for focusing a substantial part of the radiation reflected by the central zone on the bracket or brackets.

14. A headlight for a vehicle comprising:

a reflector;

a bulb mounted in the reflector; and a direct light mask disposed blockingly in relation to the bulb and mounted on the reflector by at least one mounting bracket which is generally vertically disposed and connected to the reflector;

the reflector comprising:

means for generating, without any action of a glass, a beam of light distributed widthwise in a substantially homogeneous manner between a zero inclination and a maximum inclination; and a central zone comprising means for diffusing the light reflected by the central zone thereby strengthening the luminous intensity of the beam.

* * * * *